US006212793B1

(12) United States Patent
Goad

(10) Patent No.: US 6,212,793 B1
(45) Date of Patent: Apr. 10, 2001

(54) APPARATUS AND METHOD FOR DRYING AND STORING LABORATORY CONTAINERS

(75) Inventor: Allison L. Goad, Austin, TX (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/093,519

(22) Filed: Jun. 8, 1998

(51) Int. Cl.[7] ..... F26B 25/00

(52) U.S. Cl. ..... 34/441; 34/107; 34/239; 34/106; 34/442; 211/71.01; 211/85.29

(58) Field of Search ..... 34/103, 104, 106, 34/107, 237, 239, 402, 437, 440, 441, 442; 211/71.01, 85.29, 94.02; 248/205.5, 206.2, 310, 311.3, 309.3; D7/701, 704; 206/217, 822

(56) References Cited

U.S. PATENT DOCUMENTS

| | | | | |
|---|---|---|---|---|
| 3,103,567 | * | 9/1963 | Stiller | 248/309.3 |
| 4,325,486 | * | 4/1982 | Neal | 211/85.29 |
| 4,334,623 | * | 6/1982 | Geary | 211/85.29 |
| 4,589,556 | | 5/1986 | Peretz . | |
| 5,076,445 | * | 12/1991 | Landsberger | 211/74 |
| 5,630,517 | * | 5/1997 | Maznik | 248/206.5 |
| 5,704,495 | * | 1/1998 | Bale et al. | 211/71.01 |
| 5,711,436 | | 1/1998 | Moeller et al. . | |
| 5,740,928 | * | 4/1998 | Dale et al. | 211/71.01 |

* cited by examiner

*Primary Examiner*—Stephen Gravini
(74) *Attorney, Agent, or Firm*—Conley, Rose & Tayon, P.C.; Kevin L. Daffer

(57) ABSTRACT

An apparatus and method are presented for drying and storing laboratory containers which significantly reduce the introduction of contaminants into the containers. A laboratory container system includes one or more containers and a rack for holding the containers in an inverted position. Each container has a base portion, a column portion, and a receptacle portion. A lateral dimension of the base portion is greater than that of the column portion. During use, a container is inverted, and the column portion is inserted between sides of a slot in a flat member of the rack. The spacing between the sides of the slot is sufficient to allow the column portion to pass therebetween, but not the base portion. As a result, the base portion of the container contacts an upper portion of both sides of the slot, and the container is suspended from the rack by the base portion in an inverted position. This inverted orientation of the container significantly reduces the introduction of contaminants into the receptacle portion. An apparatus for drying and storing laboratory containers (e.g., beakers or flasks) includes one or more base members, a corresponding number of means for attaching the base members to bottom surfaces of laboratory containers (e.g., suction cups), and the rack described above for holding the base members and attached containers in an inverted position.

18 Claims, 2 Drawing Sheets

APPARATUS AND METHOD FOR DRYING AND STORING LABORATORY CONTAINERS

BACKGROUND OF THE INVENTION

1. Field of the Invention

This invention relates to apparatus and methods for drying and storing laboratory containers such as beakers, flasks, etc.

2. Description of Related Art

In laboratory applications, the introduction of contaminants onto inner surfaces of containers (e.g., beakers, flasks, etc.) during drying and storing of the containers is a problem. Contaminants include liquids and solids on countertop surfaces and particulates in the air. For example, integrated circuits being prepared for scanning electron microscope (SEM) analysis are dipped in a mixture of hydrofluoric acid (HF) and water ($H_2O$). A plastic beaker is typically used to hold the HF—$H_2O$ mixture. The beaker has a flat bottom surface and an opening in an upper portion surrounded by a lip. After use, the beaker is washed and rinsed. When the beaker is allowed to air dry by placing it right side up on a countertop surface such that the bottom rests on the surface, particulates in the surrounding air may fall into the beaker and cling to the inner surfaces. When the beaker is allowed to air dry by placing it upside down on the countertop surface such that the lip rests on the surface, liquids and solids on the surface may cling to the lip. Inverting the beaker and placing it over a vertical arm of a conventional drying rack allows substances on the surface of the arm to cling to the inner surfaces of the beaker.

Conventional shelves and available drying and storage racks do not significantly reduce the contamination problem. It would thus be desirable to have an apparatus and method for drying and storing laboratory containers which significantly reduce the introduction of contaminants into the containers.

SUMMARY OF THE INVENTION

The problems outlined above are in large part solved by an apparatus and method for drying and storing laboratory containers which significantly reduce the introduction of contaminants into the containers. A laboratory container system in accordance with the present invention includes one or more containers and a rack for holding the containers in an inverted position. Each container has a base portion, a column portion, and a receptacle portion. The receptacle portion includes an upper portion having an opening surrounded by a lip. The column portion is connected between the base portion and a bottom portion of the receptacle portion. Each container may be one of several different types of laboratory containers, including various forms of beakers and flasks.

In one embodiment, the rack includes first and second flat members separated by several spacers. The spacers form channels within the rack into which the base portions of the containers are inserted. The first flat member has substantially parallel front and back surfaces, and has several slots extending from the front surface toward the back surface. Each slot has a pair of substantially parallel sides essentially forming elongated members. The sides of each slot are spaced apart to allow passage of the column portion of a container therebetween. The rack may be mounted such that the flat members are substantially horizontal.

A lateral (i.e., cross sectional) dimension of the base portion of each container is greater than a lateral dimension of the column portion. During use of the laboratory container system, a container is inverted, and the column portion of the container is inserted between the sides of a slot in the rack. The spacing between the sides of the slot is not sufficient to allow the base portion to pass therebetween. As a result, the base portion of the container contacts an upper portion of both sides of the slot, and the container is suspended from the rack by the base portion in an inverted position. This inverted orientation of the container significantly reduces the introduction of contaminants into the receptacle portion.

An apparatus for drying and storing laboratory containers in accordance with the present invention includes one or more base members, a corresponding number of means for attaching the base members to the laboratory containers (e.g., suction cups), and the rack described above for holding the base members in an inverted position. Each container may be a commercially available laboratory container, including various forms of beakers and flasks. Each container has an opening in an upper portion surrounded by a lip. A suction cup may be connected to a base member and used to removably attach the base member to a bottom surface of a container.

The sides of each slot of the first flat member (i.e., the elongated members) are spaced apart to allow passage of the suction cups therebetween. A lateral dimension of each base members is greater than a lateral dimension of the corresponding suction cup. During use of the apparatus, the bottom surface of a container is removably attached to a base member using the suction cup connected thereto. The container and the attached base member are inverted, and the suction cup is inserted between the sides of a slot in the rack. The spacing between the sides of the slot is not sufficient to allow the base member to pass therebetween. As a result, the base member contacts an upper portion of both sides of the slot, and the container is suspended from the rack in an inverted position.

BRIEF DESCRIPTION OF THE DRAWINGS

Other objects and advantages of the invention will become apparent upon reading the following detailed description and upon reference to the accompanying drawings in which.

Figure 1:
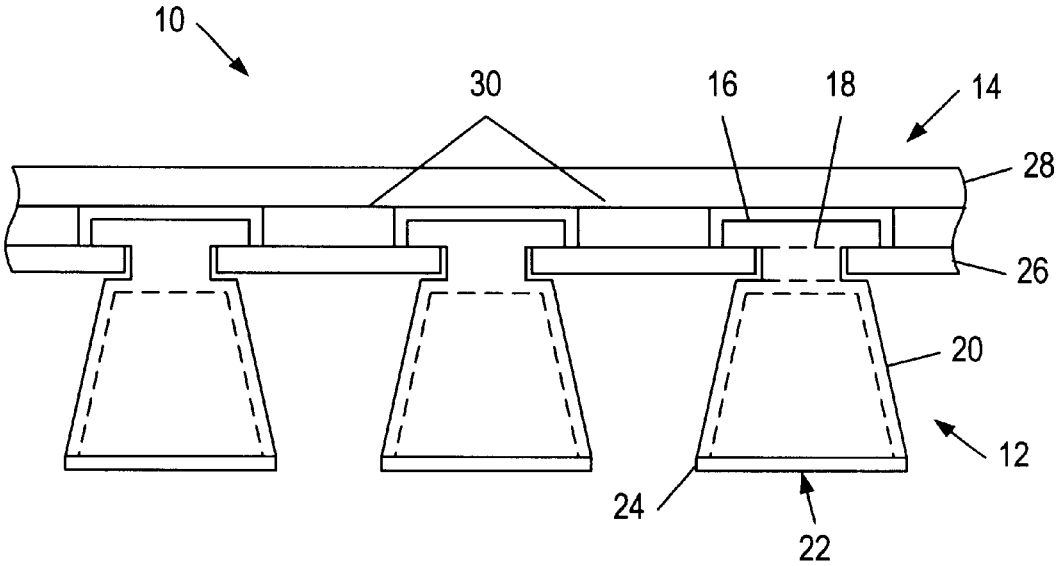
FIG. 1 is a cross sectional view of one embodiment of a laboratory container system in accordance with the present invention, wherein the laboratory container system includes one or more containers and a rack for holding the containers in an inverted position.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Turning now to the figures, FIG. 1 is a cross sectional view of one embodiment of a laboratory container system 10 in accordance with the present invention. Laboratory container system 10 includes one or more laboratory containers 12 and a rack 14 for holding containers 12 in an inverted position. Each container 12 includes a base portion 16, a column portion 18, and a receptacle portion 20. Column portion 18 is connected between base portion 16 and a bottom portion of receptacle portion 20.

Each container 12 has an opening 22 in an upper portion of receptacle portion 20. Opening 22 is surrounded by a lip 24. Each container 12 may be one of several different types of laboratory containers, including various forms of beakers and flasks. Containers 12 may be made from, for example, glass (e.g., borosilicate glass) or plastic (e.g., polypropylene, polymethylpentene, polyethylene, Teflon®, etc.). Containers 12 may be cast or molded from a suitable material as a single piece, or may be assembled by attaching two or more separate pieces together.

In the embodiment of FIG. 1, rack 14 includes a first flat member 26, a second flat member 28, and several spacers 30. Flat members 26 and 28 are substantially rigid, and may be made of, for example, plastic, metal, or wood. Spacers 30 are intermediate first flat member 26 and second flat member 28, forming channels within rack 14 into which base portions 16 of containers 12 are inserted.

Figure 2:
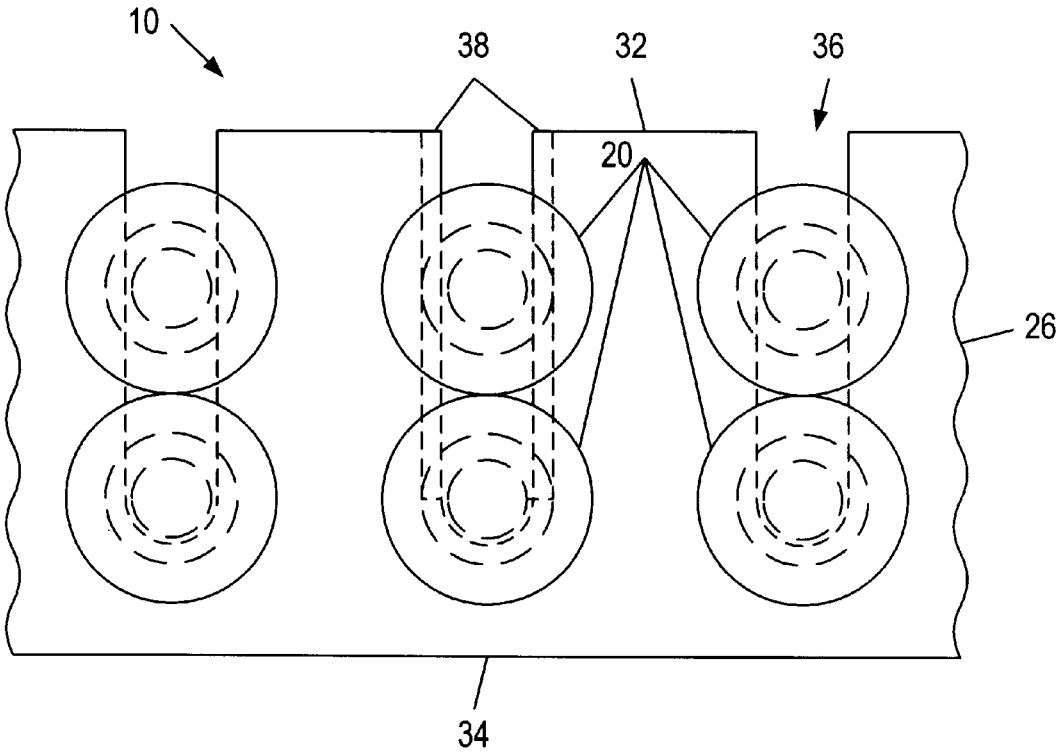
FIG. 2 is a bottom plan view of the embodiment of the laboratory container system of FIG. 1.

FIG. 2 is a bottom plan view of the embodiment of laboratory container system 10 of FIG. 1. First flat member 26 has a front surface 32 and a substantially parallel back surface 34. First flat member 26 has several slots 36 extending from front surface 32 toward back surface 34. Each slot 36 has a pair of substantially parallel sides 38 essentially forming elongated members. Sides 38 of each slot 36 (i.e., the elongated members) are spaced apart to allow passage of column portion 18 of the corresponding container 12 therebetween. Each slot 36 is preferably long enough to accommodate multiple containers 12 as shown in FIG. 2.

Base portion 16 and column portion 18 are preferably cylindrical and have substantially circular cross sections. Base portion 16 and column portion 18 may also have other cross sectional shapes, including rectangular and triangular. As shown in FIG. 1, a lateral (i.e., cross sectional) dimension of base portion 16 of each container 12 is greater than a lateral dimension of column portion 18. During use of laboratory container system 10, a container 12 is inverted, and column portion 18 of the container 12 is inserted between sides 38 of a slot 36 (i.e., elongated members) of rack 14. The spacing between sides 38 of the slot 36 is not sufficient to allow base portion 16 to pass therebetween. As a result, base portion 16 of the container 12 contacts an upper portion of both sides 38 of the slot 36, and container 12 is suspended from rack 14 by base portion 16 in an inverted position.

Rack 14 may be mounted such that flat members 26 and 28 are substantially horizontal. For example, rack 14 may be mounted against a wall such that back surface 34 contacts the wall, allowing access to front surface 32. Rack 14 may also be attached to an underside surface of a shelf such that second flat member 28 contacts the underside surface.

Containers 12 may be placed within rack 14 when dry or wet (e.g., following immersion in a liquid such as deionized water). When placed in rack 14 when wet, the free air circulation about the inner and outer surfaces of containers 12 provided by rack 14 speeds the air drying process. The inverted orientation of container 12 within rack 14 prevents airborne particulates from falling into opening 22 an clinging to an inner surface of receptacle portion 20. No surface of rack 14 touches an inner surface of receptacle portion 20 or lip 24, further preventing the introduction of contaminants. Laboratory container system 10 also saves counter space reserved for drying or storing laboratory containers.

Figure 3:
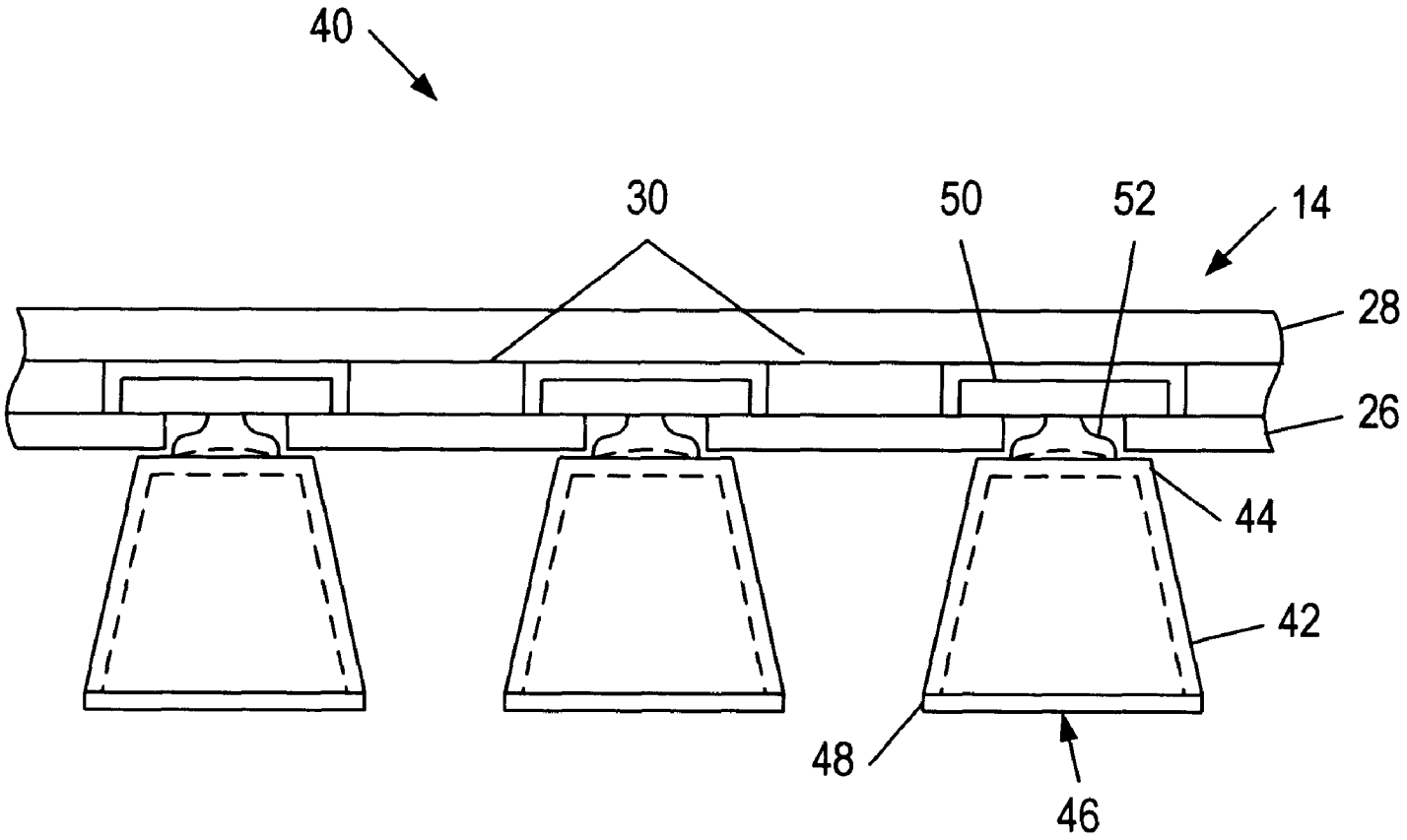
FIG. 3 is a cross sectional view of one embodiment of an apparatus for drying and storing laboratory containers in accordance with the present invention, wherein the apparatus includes one or more base members, a corresponding number of means for attaching the base members to bottom surfaces of the laboratory containers (e.g., suction cups), and the rack of FIGS. 1 and 2 for holding the base members and attached containers in an inverted position.

FIG. 3 is a cross sectional view of one embodiment of an apparatus 40 for drying and storing laboratory containers 42 in accordance with the present invention. Each container 42 may be a commercially available laboratory container, including various forms of beakers and flasks. Each container 42 has a bottom portion 44 and an opening 46 in an upper portion surrounded by a lip 48. Containers 42 may be made from, for example, glass (e.g., borosilicate glass) or plastic (e.g., polypropylene, polymethylpentene, polyethylene, Teflon®, etc.).

Apparatus 40 includes one or more base members 50, a corresponding number of suction cups 52, and rack 14 for holding base members 50 in an inverted position. Each suction cup 52 is connected to a corresponding base member 50, and is used to removably attach the corresponding base member 50 to a bottom surface of a container 42. Spacers 30 form channels within rack 14 into which base members 50 are inserted. Sides 38 of each slot 36 (i.e., the elongated members) of first flat member 26 are spaced apart to allow passage of suction cups 52 therebetween.

As shown in FIG. 3, a lateral (i.e., cross sectional) dimension of base members 50 is greater than a lateral dimension of suction cups 52. During use of apparatus 40, the bottom surface of a container 42 is removably attached to a base member 50 using the suction cup 52 connected thereto. For example, the bottom surface of the container 42 may be pressed against the suction cup 52 until a significant quantity of the air within the suction cup 52 is forced out. The vacuum thus formed between the suction cup 52 and the bottom surface of the container 42 removably attaches the container 42 to the base member 50. The container 42 and the attached base member 50 are inverted, and the suction cup 52 is inserted between sides 38 of a slot 36 (i.e., elongated members) of rack 14. The spacing between sides 38 of the slot 36 is not sufficient to allow base member 50 to pass therebetween. As a result, base member 50 contacts an upper portion of both sides 38 of the slot 36, and container 42 is suspended from rack 14 in an inverted position. This inverted orientation of container 42 significantly reduces the introduction of contaminants as described above.

It will be appreciated by those skilled in the art having the benefit of this disclosure that this invention is believed to be an apparatus and method for drying and storing laboratory containers which significantly reduce the introduction of contaminants into the containers. It is intended that the following claims be interpreted to embrace all such modifications and changes and, accordingly, the specification and drawings are to be regarded in an illustrative rather than a restrictive sense.

What is claimed is:

1. A laboratory container system, comprising:

a container including a base portion, a column portion, and a receptacle portion, wherein the column portion is connected between the base portion and a bottom portion of the receptacle portion;

a rack for holding the container in an inverted position, comprising:

a first planar member having substantially parallel front and back surfaces and a slot extending from the front surface toward the back surface, wherein the slot has a pair of opposed sides spaced apart to allow passage of the column portion of the container therebetween; and a second planar member positioned substantially parallel to the first planar member and coupled to the first planar member via a plurality of spacers, wherein two of the spacers are positioned on either side of the slot such that a channel is formed between the spacers coincident with the slot, and wherein the channel is dimensioned to receive the base portion of the container.

2. The laboratory container system as recited in claim 1, wherein a lateral dimension of the base portion of the container is greater than a lateral dimension of the column portion.

3. The laboratory container system as recited in claim 1, wherein when the container is inverted and inserted into the rack, the base portion of the container contacts an upper portion of the pair of opposed sides of the slot.

4. The laboratory container system as recited in claim 1, wherein an upper portion of the receptacle portion of the container has an opening surrounded by a lip.

5. The laboratory container system as recited in claim 1, wherein the first and second planar members are mounted substantially horizontally during use.

6. A laboratory container system, comprising:

a container including a base portion, a column portion, and a receptacle portion, wherein the column portion is connected between the base portion and a bottom portion of the receptacle portion;

a rack for holding the container in an inverted position, comprising:

a first planar member having substantially parallel front and back surfaces, and wherein the first planar member has a plurality of slots extending from the front surface and toward the back surface, and wherein each slot has a pair of opposed sides spaced apart to allow passage of the column portion of the container therebetween; and a second planar member positioned substantially parallel to the first planar member and coupled to the first planar member via a plurality of spacers, wherein a portion of the spacers are positioned between the slots such that a channel is formed between adjacent spacers coincident with each slot, and wherein each channel is dimensioned to receive the base portion of the container.

7. The laboratory container system as recited in claim 6, wherein when the container is inverted and inserted into the rack, the base portion of the container contacts an upper portion of the pair of opposed sides of one of the slots.

8. The laboratory container system as recited in claim 6, wherein the first and second planar members are mounted substantially horizontally during use.

9. A method for drying and storing a laboratory container having a base portion, a column portion, and a receptacle portion, wherein the column portion is connected between the base portion and a bottom portion of the receptacle portion, the method comprising:

providing a rack for holding the container in an inverted position, wherein the rack comprises:

a first planar member having substantially parallel front and back surfaces and a slot extending from the front surface toward the back surface, wherein the slot has a pair of opposed sides spaced apart to allow passage of the column portion of the container therebetween; and a second planar member positioned substantially parallel to the first planar member and coupled to the first planar member via a plurality of spacers, wherein two of the spacers are positioned on either side of the slot such that a channel is formed between the spacers coincident with the slot, and wherein the channel is dimensioned to receive the base portion of the container;

inverting the container; and inserting the base portion of the container into the channel such that the column portion of the container is positioned between the pair of opposed sides of the slot and the base portion of the container contacts an upper portion of the pair of opposed sides of the slot.

10. An apparatus for drying and storing a laboratory container, comprising:

a base member;

means for removably attaching the base member to a bottom surface of the container;

a rack for holding the base member in an inverted position, wherein the rack comprises:

a first planar member having substantially parallel front and back surfaces and a slot extending from the front surface toward the back surface, wherein the slot has a pair of opposed sides spaced apart to allow passage of the attaching means therebetween; and a second planar member positioned substantially parallel to the first planar member and coupled to the first planar member via a plurality of spacers, wherein two of the spacers are positioned on either side of the slot such that a channel is formed between the spacers coincident with the slot, and wherein the channel is dimensioned to receive the base member.

11. The apparatus as recited in claim 10, wherein the means comprises a suction cup attached to the base member.

12. The apparatus as recited in claim 11, wherein a lateral dimension of the base member is greater than a lateral dimension of the suction cup.

13. The apparatus as recited in claim 11, wherein when the container with the base member attached thereto is inverted and inserted into the rack, the base member contacts an upper portion of the pair of opposed sides of the slot.

14. The apparatus as recited in claim 10, wherein the first and second planar members are mounted substantially horizontally during use.

15. An apparatus for drying and storing a laboratory container, comprising:

a base member;

a suction cup connected to the base member and adapted for removably attaching the base member to a bottom surface of the container; and a rack for holding the base member in an inverted position, wherein the rack comprises:

a first planar member having substantially parallel front and back surfaces and a slot extending from the front surface toward the back surface, wherein the slot has a pair of opposed sides spaced apart to allow passage of the suction cup therebetween; and a second planar member positioned substantially parallel to the first planar member and coupled to the first planar member via a plurality of spacers, wherein two of the spacers are positioned on either side of the slot such that a channel is formed between the spacers coincident with the slot, and wherein the channel is dimensioned to receive the base member.

16. The apparatus as recited in claim 15, wherein when the container with the base member attached thereto is inverted and inserted into the rack, the base member contacts an upper portion of the pair of opposed sides of the slot.

17. The apparatus as recited in claim 15, wherein the first and second planar members are mounted substantially horizontally during use.

18. A method for drying and storing a laboratory container, comprising:

providing:

a base member;

a suction cup connected to the base member and adapted for attaching to the container; and a rack for holding the base member in an inverted position, wherein the rack comprises:

a first planar member having substantially parallel front and back surfaces and a slot extending from the front surface toward the back surface, wherein the slot has a pair of opposed sides spaced apart to allow passage of the suction cup therebetween; and a second planar member positioned substantially parallel to the first planar member and coupled to the first planar member via a plurality of spacers, wherein two of the spacers are positioned on either side of the slot such that a channel is formed between the spacers coincident with the slot, and wherein the channel is dimensioned to receive the base member;

attaching a bottom surface of the container to the base member using the suction cup;

inverting the container with the base member coupled thereto; and inserting the base member into the channel such that the suction cup is positioned between the pair of opposed sides of the slot and the base member contacts an upper portion of the pair of opposed sides of the slot.

* * * * *